US007656265B2

(12) United States Patent
Catalano et al.

(10) Patent No.: US 7,656,265 B2
(45) Date of Patent: Feb. 2, 2010

(54) APPARATUS AND METHOD FOR ESTABLISHING A MAGNETIC CIRCUIT

(75) Inventors: Robert James Catalano, Mesquite, TX (US); Robert Joseph Roessler, Rockwall, TX (US); Karim Nashaat Wassef, Richardson, TX (US)

(73) Assignee: Lineage Power Corporation, Plano, TX (US)

( * ) Notice: Subject to any disclaimer, the term of this patent is extended or adjusted under 35 U.S.C. 154(b) by 307 days.

(21) Appl. No.: 11/299,573

(22) Filed: Dec. 12, 2005

(65) Prior Publication Data

US 2007/0132538 A1 Jun. 14, 2007

(51) Int. Cl.
*H01F 27/28* (2006.01)

(52) U.S. Cl. ..... 336/229

(58) Field of Classification Search ..... 336/65, 336/83, 192, 200, 225, 229
See application file for complete search history.

(56) References Cited

U.S. PATENT DOCUMENTS 3,551,864 A * 12/1970 Spoldi et al. ..... 336/83
3,764,971 A * 10/1973 Brobeck ..... 340/984
4,013,911 A * 3/1977 Fujiwara et al. ..... 340/870.35
4,613,841 A * 9/1986 Roberts ..... 336/83
5,506,560 A * 4/1996 Takeuchi et al. ..... 336/83
7,057,486 B2 * 6/2006 Kiko ..... 336/178

* cited by examiner

*Primary Examiner*—Tuyen Nguyen
(74) *Attorney, Agent, or Firm*—Law Office of Donald D. Mondul

(57) ABSTRACT

An apparatus for establishing at least one turn for a magnetic circuit includes: (a) at least one first magnetic element oriented substantially about an axis generally between a first axial position and a second axial position; and (b) at least one second magnetic element coupled with at least one selected first magnetic element of the at least one first magnetic element generally at the second axial position. The at least one second magnetic element establishes at least one return magnetic path from the second axial position generally toward the first axial position. The at least one return magnetic path is generally about the axis.

15 Claims, 7 Drawing Sheets

APPARATUS AND METHOD FOR ESTABLISHING A MAGNETIC CIRCUIT

BACKGROUND OF THE INVENTION

The present invention is directed to magnetic components, and especially to magnetic components useful in establishing a magnetic circuit. Prior art magnetic structures including, by way of example and not by way of limitation, planar magnetic structures, toroidal magnetic structures and wire wound magnetic structures occupy relatively large volumes manifested in high height, large footprint on a substrate or other dimensions. Prior art magnetic structures can also experience inefficient operation at high currents and high frequencies that can be manifested in low field coupling, hot spots and other inefficiencies.

There is a need for magnetic circuit components that can be effectively employed in high frequency, high current, low resistance applications especially while presenting a small package. The small package aspect of the present invention may be manifested to advantage in one or more of a smaller footprint on a circuit substrate, a lower height above a substrate and other advantageous dimensions that may be realized by providing a small occupied volume in a finished component.

SUMMARY OF THE INVENTION

An apparatus for establishing at least one turn for a magnetic circuit includes: (a) at least one first magnetic element oriented substantially about an axis generally between a first axial position and a second axial position; and (b) at least one second magnetic element coupled with at least one selected first magnetic element of the at least one first magnetic element generally at the second axial position. The at least one second magnetic element establishes at least one return magnetic path from the second axial position generally toward the first axial position. The at least one return magnetic path is generally about the axis.

A method for establishing at least one turn for a magnetic circuit; the method includes the steps of: (a) In no particular order: (1) providing at least one first magnetic element; and (2) providing at least one second magnetic element. (b) Orienting the at least one first magnetic element substantially about an axis generally between a first axial position and a second axial position. (c) Coupling the at least one second magnetic element with at least one selected first magnetic element of the at least one first magnetic element generally at the second axial position to establish at least one return magnetic path from the second axial position generally toward the first axial position. The at least one return magnetic path is generally about the axis.

It is, therefore, an object of the present invention to provide a magnetic circuit component that can be effectively employed in high frequency, high current, low resistance applications while presenting a small package.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Figure 1:
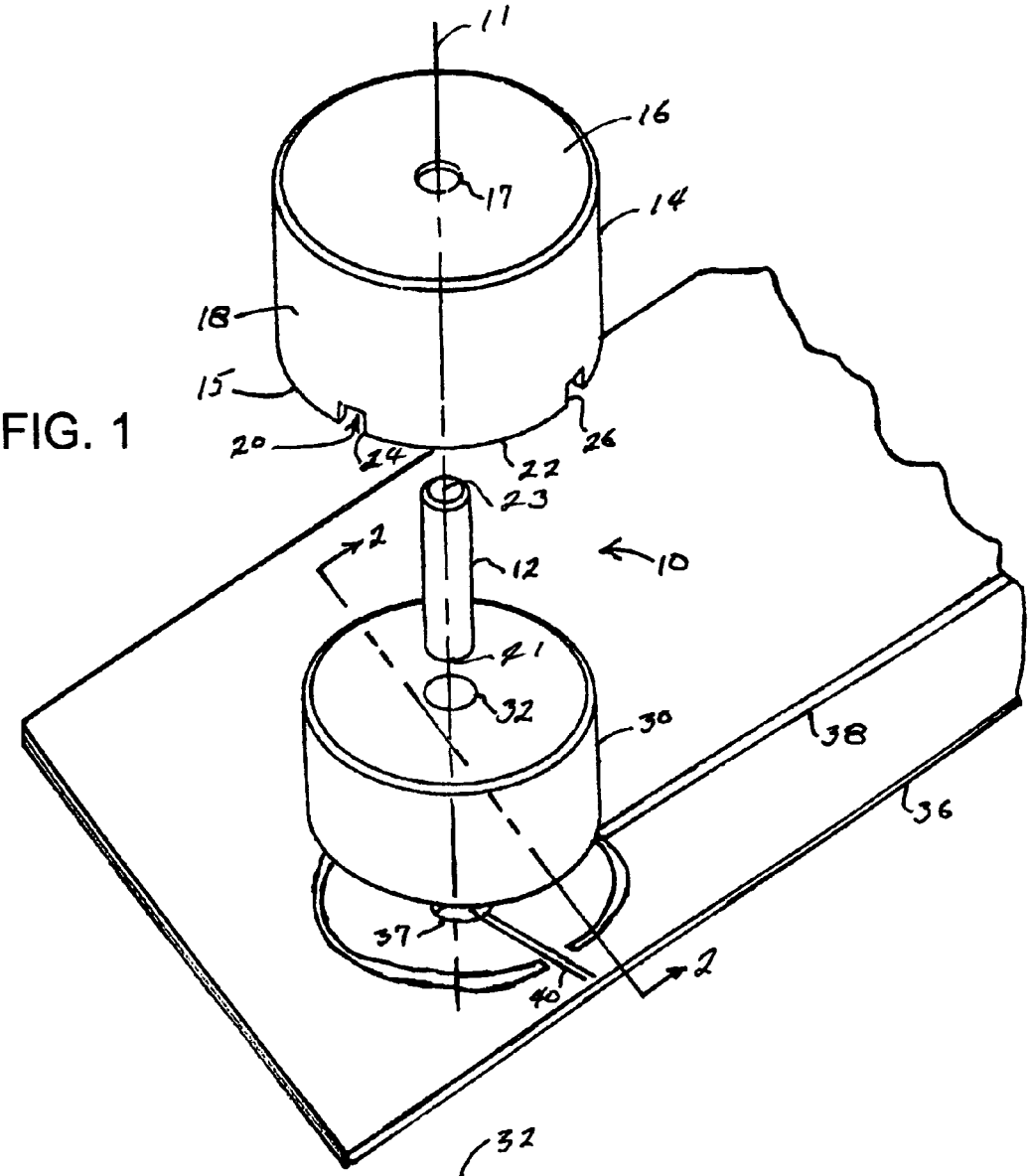
FIG. 1 is an exploded perspective view of a first embodiment of the apparatus of the present invention.

An important feature of the present invention is the employment of a large-mass structure for carrying high currents in a magnetic circuit path. One example of such a high-mass structure is a rod having a generally polygonal cross-section, such as a pentagon or a circle (herein regarded as a polygon having infinite number of sides). Such a high-mass structure can provide current-carrying capacity for high current from a first locus to a second locus in a magnetic circuit path. Using a bent rod in an electromagnetic component has been known, but such bent rod structures present an unacceptably high height, especially when configured with sufficient mass to handle high current applications. By way of example and not by way of limitation, the high mass magnetic circuit path structure of the present invention may be oriented generally about an axis and current may be carried in a first magnetic circuit path segment from a first axial position to a second axial position. Such a high mass magnetic circuit path structure may embody a first magnetically conductive element. A return magnetic circuit path segment may be provided from the second axial position in a direction toward the first axial position by a magnetically conductive structure substantially surrounding the axis. Such a magnetically conductive structure providing a return magnetic path segment may embody a second magnetically conductive element. The return magnetic circuit path segment may be configured using a solid wall structure, a latticed wall structure, a wire cage structure or another structure that supports establishing the required return magnetic circuit path with the desired current-carrying capacity.

Such a surrounding relationship by the return magnetic circuit path segment about the first magnetic circuit path segment establishes a mirror-like relationship between first magnetic fields traversing the first magnetic circuit path segment from the first axial position to the second axial position and second magnetic fields traversing the return magnetic path segment from the second axial position toward the first axial position. Such a mirror-like relation between two portions of an established magnetic field contributes to efficient magnetic coupling that is particularly well suited for use in high frequency applications.

The present invention may be configured in multi-layered structures using more than one of the magnetic circuit path structures described above. One exemplary such multi-layered structure includes a plurality of the above-described magnetic circuit path structures in a nested structure substantially oriented about a common axis. Interleaving of magnetic circuits using such a nested orientation may be effected by selectively weaving electrical lines in serpentine inter-layer or intra-layer winding paths among the various nested magnetic circuit path structures.

Connection of a center post with a substrate for effecting electrical inclusion of the apparatus of the present invention in a circuit provides an opportunity for easy inspection to assure a good connection. One may provide a pin hole axially through the rod so that a visual inspection may be made from a proximate end of the rod into the pin hole after connection with a substrate is completed to observe the quality of the connection made at a distal end of the rod with the substrate.

FIG. 1 is an exploded perspective view of a first embodiment of the apparatus of the present invention. In FIG. 1, a magnetic circuit apparatus 10 includes a first magnetic circuit path segment structure embodied in a rod 12 situated between a first axial locus or position 21 and a second axial locus or position 23. Rod 12 may embody a first magnetically conductive element. A return magnetic circuit path segment is embodied in a preferably cylindrical can 14 having a downward-facing rim 15. Can 14 may embody a second magnetically conductive element. Rod 12 and can 14 are substantially oriented about an axis 11. Can 14 is configured with a closed end 16 and a wall 18 establishing a hollow cavity 20 with an open end 22. Can 14 may have a cross section in the shape of any polygon in planes substantially perpendicular with axis 11. An aperture 17 is provided in closed end 16 to cooperate with rod 12 for coupling rod 12 with can 14 to establish magnetic circuit apparatus 10 as an integral structure. When rod 12 and can 14 are in an assembled orientation, can 14 establishes a return magnetic circuit path segment from second axial position 23 toward first axial position 21. First axial position 21 may embody a first locus. Second axial position 23 may embody a second locus. Other methods for configuring rod 16 and can 14 as an integral structure may include, by way of example and not by way of limitation, cold forming apparatus 10 by stamping, drawing, peening or otherwise deforming a raw material mass to the desired integral structure. Still other manufacturing techniques for manufacturing apparatus 10 as an integral structure may include, by way of further example and not by way of limitation, forging, casting and other hot processes for material forming.

An electromagnetic structure 30 may be configured for insertion within cavity 20. Electromagnetic structure 30 is provided with an aperture 32 for receiving rod 12 therethrough. A substrate 36 supports circuit traces 38, 40. Circuit trace 38 is configured for effecting contact with substantially all of rim 15. Rim 15 may be flared to provide a greater area of contact with circuit trace 38 when apparatus 10 is in an installed orientation on substrate 36. Circuit trace 38 may embody a first electrical termination structure. Circuit trace 40 effects contact with rod 12 when apparatus 10 is in an assembled orientation with rod 12 traversing electromagnetic structure 30 to electrically contact substrate 36 in an aperture 37. Circuit trace 40 may embody a second electrical termination structure. Aperture 37 and rod 12 are preferably configured to cooperate in effecting a press fit of rod 12 within aperture 37. Circuit trace 40 is preferably coupled with aperture 37 to effect an electrical connection with rod 12 when rod 12 is press fit within aperture 37. Notches 24, 26 may be provided in rim 15 to accommodate passage of circuit traces such as circuit trace 40 beneath rim 15 without electrically contacting rim 15. Other notches may also be provided in rim 15 to accommodate passage of other circuit traces (not shown in FIG. 1) thereby simplifying circuit layout on a substrate in the vicinity of apparatus 10. In an assembled orientation, circuit trace 40 electrically contacts rod 12 (press fit within aperture 37), rod 12 electrically contacts can 14 by the integral structure of rod 12 and can 14. Can 14 electrically couples with circuit trace 38 by rim 15. In such an arrangement magnetic circuit apparatus 10 may be included in a product by effecting coupling with circuit traces 38, 40.

Figure 2:
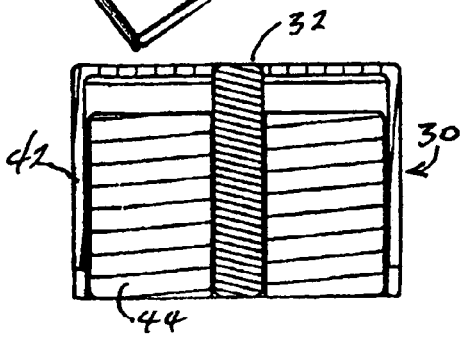
FIG. 2 is a section view of the electromagnetic structure illustrated in FIG. 1 in an assembled orientation, taken along Section 2-2 in FIG. 1.

FIG. 2 is a section view of the electromagnetic structure illustrated in FIG. 1 in an assembled orientation, taken along Section 2-2 in FIG. 1. In FIG. 2, electromagnetic structure 30 includes a wall 42 in substantially surrounding relation with respect to aperture 32. An electrical winding structure 44 is situated within wall 42 in surrounding relation about aperture 32. Leads to provide electrical connection (not shown in FIG. 2) may be provided via notches 24, 26 or other notches in rim 15 (not visible in FIG. 2; see FIG. 1).

Figure 3:
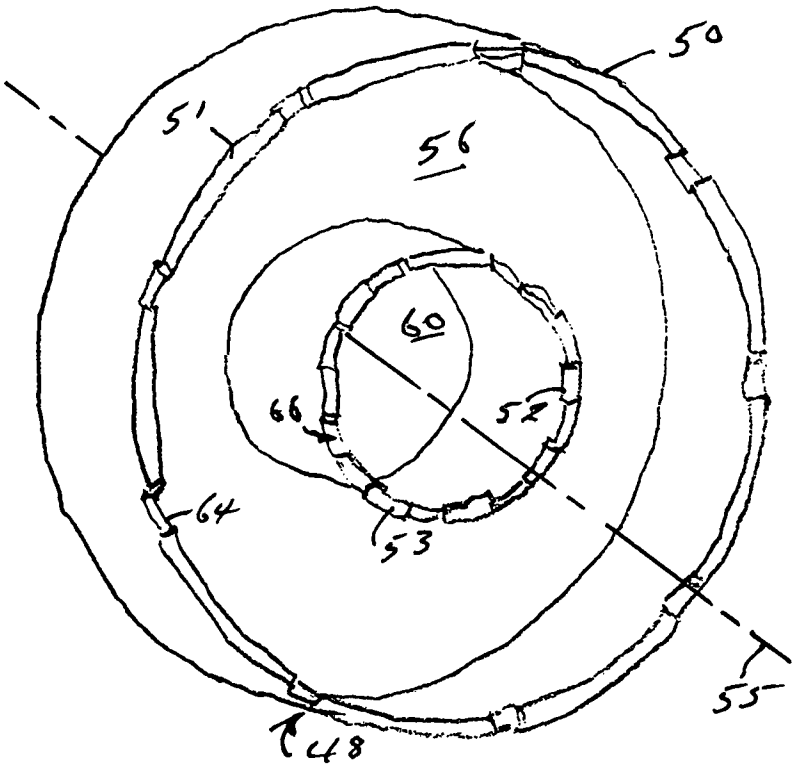
FIG. 3 is a perspective view of a shell for use in an interleaved structure employing the present invention without a component installed therein.
Figure 4:
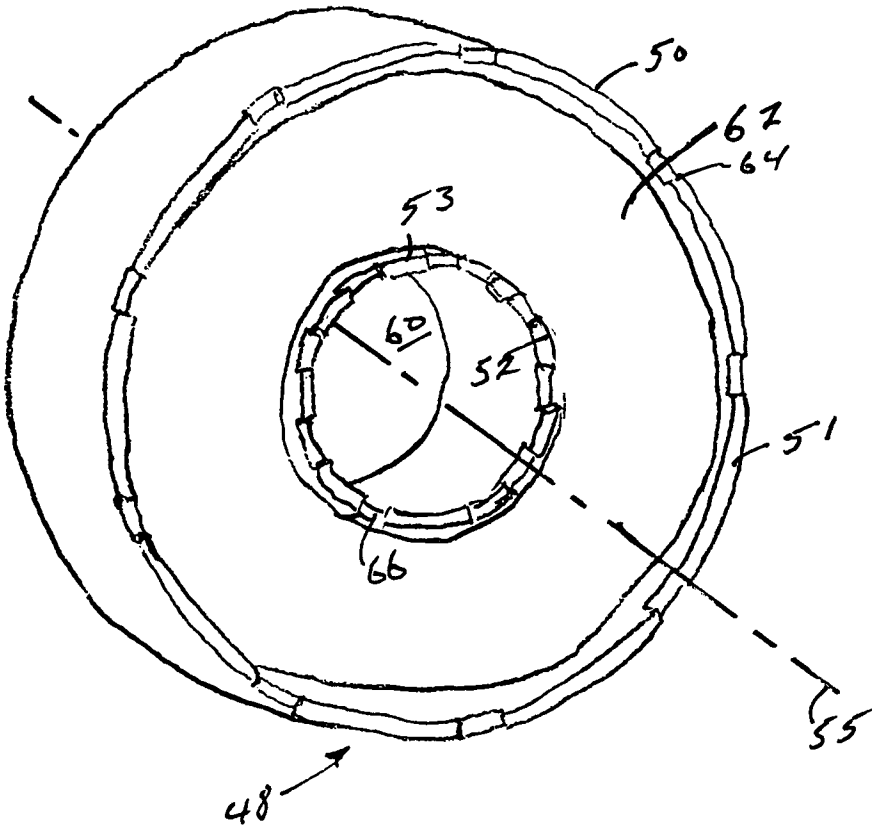
FIG. 4 is a perspective view of a shell for use with the present invention with a component installed therein.

FIG. 3 is a perspective view of a shell for use in an interleaved structure employing the present invention without a component installed therein. FIG. 4 is a perspective view of a shell for use with the present invention with a component installed therein. Regarding FIGS. 3 and 4 together, a shell 48 includes an outer wall 50 and an inner wall 52. Each of walls 50, 52 is generally symmetrically oriented about an axis 55. Walls 50, 52 are joined together at one end by a common end closure 56 (visible in FIG. 3). Inner wall 52 and end closure 56 cooperate to establish an aperture 60 that traverses shell 48. An electromagnetic component or structure 62 is nested within shell 48 between walls 50, 52 in surrounding relation about aperture 60 (FIG. 4). Electromagnetic structure 62 may be embodied in a magnetic core, a wound magnetic coil structure, a wound coil about a magnetic core or another electromagnetically contributing structure. It is preferred that electromagnetic structure 62 not extend beyond the edges 51, 53 of walls 50, 52. Notches 64 are provided in wall 52 and notches 66 are provided in wall 52 to permit electrical access to wall 52 or to electromagnetic structure 62 generally as described above in connection with notches 24, 26 in FIG. 1. Other notches may also be provided in walls 50, 52 to accommodate passage of other circuit traces thereby simplifying circuit layout on a substrate in the vicinity of shell 48 (not shown in FIGS. 3 and 4).

Figure 5:
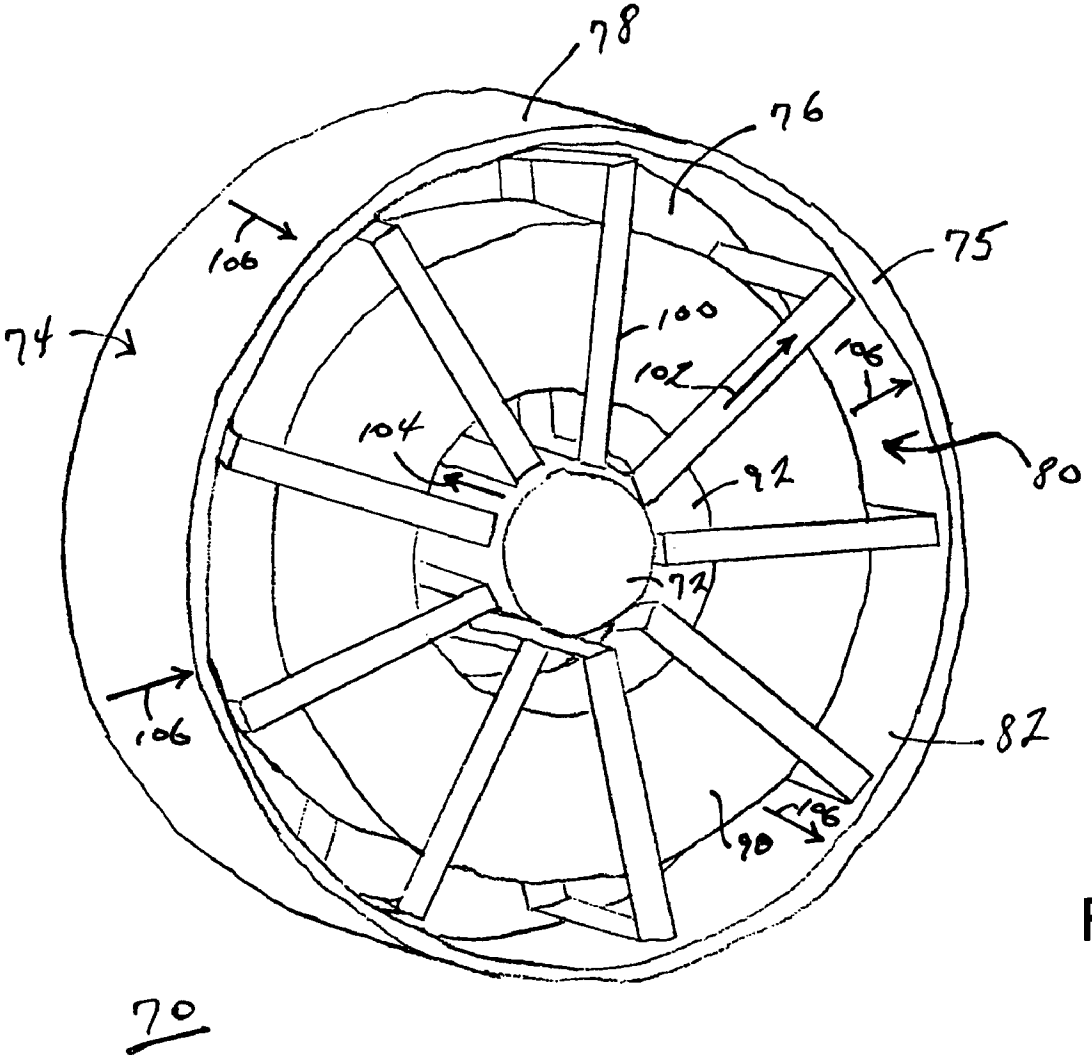
FIG. 5 is a perspective view of a configuration of the apparatus of the present invention useful as a current sense transformer device.

FIG. 5 is a perspective view of a configuration of the apparatus of the present invention useful as a current sense transformer device. In FIG. 5, an electromagnetic apparatus 70 includes a first magnetic circuit path segment structure embodied in a rod 72 and a return magnetic circuit path segment embodied in a cylindrical can 74 having a rim 75. Rod 72 may embody a first magnetically conductive element. Can 74 may embody a second magnetically conductive element. Can 74 is configured with a closed end 76 and a wall 78 establishing a hollow cavity 80 with an open end 82. Rod 72 may be coupled with can 74 to establish an integral structure by inserting rod into an aperture in the closed end structure (see FIG. 1). Other methods for establishing rod 72 with can 74 as an integral structure may include, by way of example and not by way of limitation, cold forming by stamping, drawing, peening or otherwise deforming a raw material mass to the desired integral structure. Still other manufacturing techniques for establishing rod 72 with can 74 as an integral structure may include, by way of further example and not by way of limitation, forging, casting and other hot processes for material forming.

An electromagnetic structure 90 is nested within cavity 80 in surrounding relation about rod 72. Electromagnetic structure 90 may be embodied in a magnetic core, a wound magnetic coil structure, a wound coil about a magnetic core or another electromagnetically contributing structure. When apparatus 70 is configured as a current transformer, electromagnetic structure 90 is preferably embodied in a magnetic core.

An electrical winding 100 is oriented around electromagnetic structure 90 within cavity 80. It is preferred that electromagnetic structure 90 and winding 100 not extend beyond the rim 75 of can 74. Notches may be provided in rim 75 to permit electrical access to rod 72 or to electromagnetic structure 90 generally as described above in connection with notches 24, 26 in FIG. 1 (not shown in FIG. 5). Other notches may also be provided in rim 75 to accommodate passage of other circuit traces (not shown in FIG. 5) thereby simplifying circuit layout on a substrate in the vicinity of apparatus 70. In the configuration illustrated in FIG. 5, rod 72 and can 74 cooperate to establish a single turn portion for a current transformer and winding 100 establishes a multi-turn portion for the current transformer.

By way of illustration and not by way of limitation, current may be established to flow through winding 100 in a direction indicated by an arrow 102, and current may be established to flow through rod 72 in a direction indicated by an arrow 104. That arrangement establishes a current flow through all surfaces of can 74 in a direction representatively indicated by arrows 106. Establishing current flows in apparatus 70 as indicated by arrows 102, 104, 106 configures apparatus 70 for handling high frequency signals. Current in winding 100 (arrow 102) is opposite to current in rod 72 (arrow 104) everywhere that winding 100 faces rod 72. Mirror images of current are thus established in winding 100 and rod 72. Similarly, current in winding 100 (arrow 102) is opposite to current in can 74 (arrow 106) everywhere that winding 100 faces can 74. Mirror images of current are thus established in winding 100 and can 74. Mirror images of current are also established in rod 72 and can 74. Moreover, the three-dimensional nature of the structure of apparatus 70 establishes the desirable mirror image currents in a 360 degree arrangement around rod 72, can 74 and winding 100. Such a three-dimensional mirror image current arrangement contributes to efficient handling of high frequency signaling by apparatus 70. In structures not providing such mirror imaging of currents, current flow tends to migrate toward edges in the structure thereby causing hot spots and contributing to inefficiency of operation. The mass of material that makes up rod 72 and can 74 provides a capability for apparatus 70 to handle high currents while presenting a small package. The small package may be manifested as low height, small footprint, low volume or another combination using small size to advantage for a particular application using apparatus 70. Thus, apparatus 70 is a magnetic circuit component that can be effectively employed in high frequency, high current, low resistance applications while presenting a small package.

Figure 6:
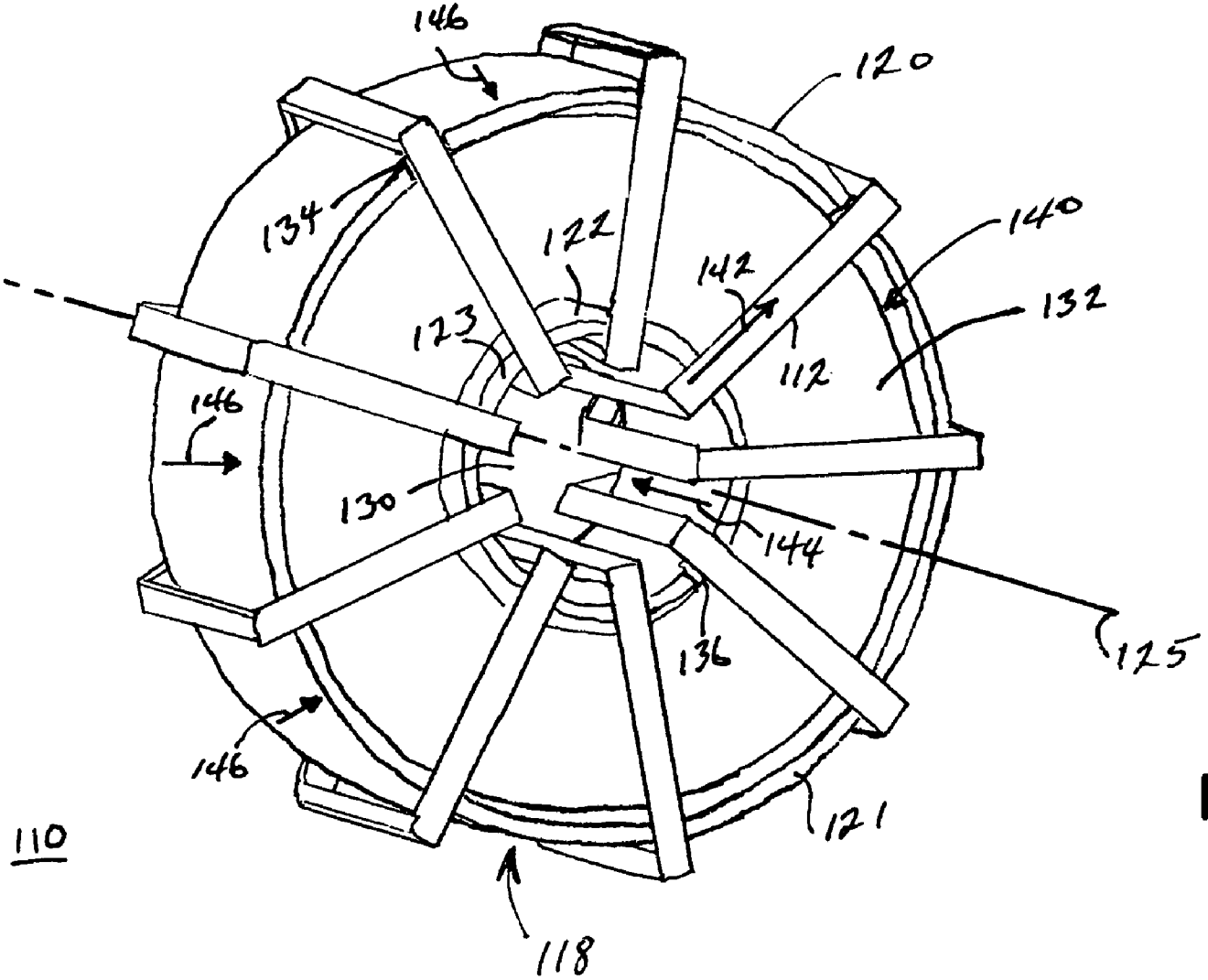
FIG. 6 is a perspective view of the apparatus of the present invention configured for employment as an electromagnetic apparatus having a primary winding and a secondary winding.

FIG. 6 is a perspective view of the apparatus of the present invention configured for employment as an electromagnetic apparatus having a primary winding and a secondary winding. In FIG. 6, an electromagnetic apparatus 110 substantially is configured as described in FIG. 4 with an added electrical winding 112. A shell 118 includes an outer wall 120 and an inner wall 122. Inner wall 122 may embody a first magnetically conductive element. Outer wall 120 may embody a second magnetically conductive element. Each of walls 120, 122 is generally symmetrically oriented about an axis 125. Walls 120, 120 are joined together at one end by a common end closure (not visible in FIG. 6; see FIG. 3). The common end closure may embody a second locus. Inner wall 122 and the end closure cooperate to establish an aperture 130 that traverses shell 118. An electromagnetic structure 132 is nested within shell 118 between walls 120, 122 in surrounding relation about aperture 130. Electromagnetic structure 132 may be embodied in a magnetic core, a wound magnetic coil structure, a wound coil about a magnetic core or another electromagnetically contributing structure. It is preferred that electromagnetic structure 132 not extend beyond edges 121, 123 of walls 120, 122. Edge 123 closure may embody a first locus. Notches 134 are provided in wall 120 and notches 136 are provided in wall 122 to permit electrical access to wall 122 or to electromagnetic structure 132 generally as described above in connection with notches 24, 26 in FIG. 1. Other notches may also be provided in walls 120, 122 to accommodate passage of other circuit traces (not shown in FIG. 6) thereby simplifying circuit layout on a substrate in the vicinity of apparatus 110.

Electrical winding 112 is oriented around electromagnetic structure 110 within a cavity 140 bounded by walls 120, 122 and the end closure joining walls 120, 122 (not visible in FIG. 6; see FIG. 3). It is preferred that electromagnetic structure 132 and winding 112 not extend beyond edges 121, 123 of walls 120, 122. Notches 134, 136 in edges 121, 123 may permit electrical passage by winding 112 to contribute toward a low profile structure for apparatus 110. In the configuration illustrated in FIG. 6, inner wall 122 and outer wall 120 may cooperate to establish one of a primary winding and a secondary winding, and winding 112 establishes the other winding of a primary winding and a secondary winding.

By way of illustration and not by way of limitation, current may be established to flow through winding 112 in a direction indicated by an arrow 142, and current may be established to flow through wall 122 in a direction indicated by an arrow 144. That arrangement establishes a current flow through all surfaces of wall 120 in a direction representatively indicated by arrows 146. Establishing current flows in apparatus 110 as indicated by arrows 142, 144, 146 configures apparatus 110 for handling high frequency signals. Current in winding 112 (arrow 142) is opposite to current in wall 122 (arrow 144) everywhere that winding 112 faces wall 122. Mirror images of current are thus established in winding 112 and wall 122. Similarly, current in winding 112 (arrow 142) is opposite to current in wall 120 (arrow 146) everywhere that winding 112 faces wall 120. Mirror images of current are thus established in winding 112 and wall 120. Mirror images of current are also established in wall 122 and wall 120. Moreover, the three-dimensional nature of the structure of apparatus 110 establishes the desirable mirror image currents in a 360 degree arrangement around wall 122, wall 120 and winding 112. Such a three-dimensional mirror image current arrangement contributes to efficient handling of high frequency signaling by apparatus 110. In structures not providing such mirror imaging of currents, current flow tends to migrate toward edges in the structure thereby causing hot spots and contributing to inefficiency of operation. The mass of material that makes up wall 120, wall 120 and the end closure joining walls 120, 122 (not visible in FIG. 6; see FIG. 3) provides a capability for apparatus 110 to handle high currents while presenting a small package. The small package may be manifested as low height, small footprint, low volume or another combination using small size to advantage for a particular application using apparatus 110. Thus, apparatus 110 is a magnetic circuit component that can be effectively employed in high frequency, high current, low resistance applications while presenting a small package.

Figure 7:
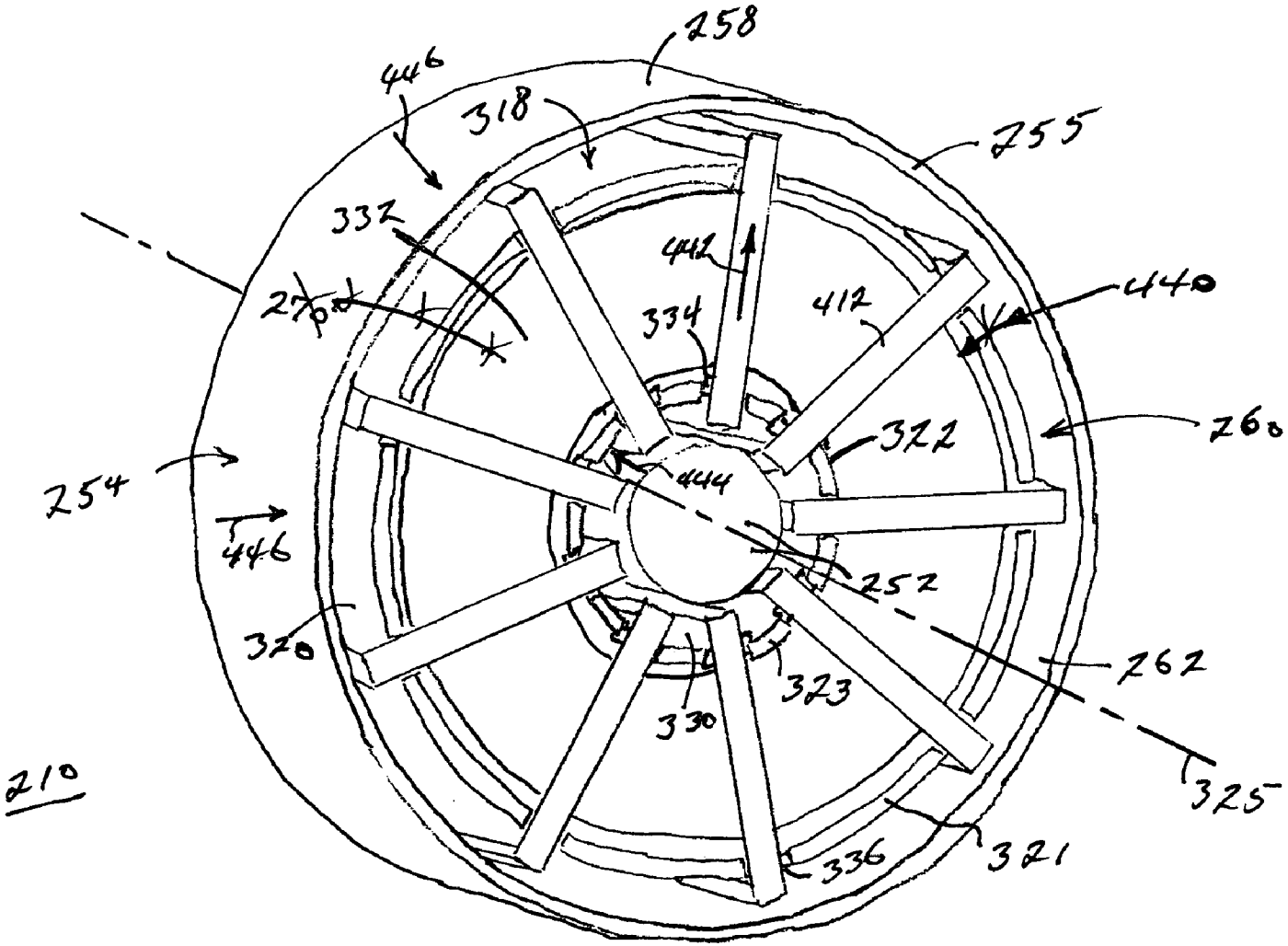
FIG. 7 is a perspective view of an interleaved shell configuration of the apparatus of the present invention.

FIG. 7 is a perspective view of an interleaved shell configuration of the apparatus of the present invention. In FIG. 7, an electromagnetic apparatus 210 substantially includes a shell (configured substantially like shell 48; described in FIG. 4) nested within a can-and-rod structure (configured substantially as described in FIGs. 4 and 5) and an electrical winding 412. Electromagnetic apparatus 210 therefore includes a first magnetic circuit path segment structure embodied in a rod 252 and a return magnetic circuit path segment embodied in a cylindrical can 254 having a rim 255. Rod 252 may embody a first magnetically conductive element. Can 254 may embody a second magnetically conductive element. Can 254 is configured with a closed end (not visible in FIG. 7; see FIG. 5) and a wall 258 establishing a hollow cavity 260 with an open end 262. Rod 252 may be coupled with can 254 to establish an integral structure by inserting rod into an aperture in the closed end structure (see FIG. 1). The end of rod 252 distal from the coupling of rod 252 with can 254 may embody a first locus. Coupling rod 252 with can 254 may establish an embodiment of a second locus. Other methods for establishing rod 252 with can 254 as an integral structure may include, by way of example and not by way of limitation, cold forming by stamping, drawing, peening or otherwise deforming a raw material mass to the desired integral structure. Still other manufacturing techniques for establishing rod 252 with can 254 as an integral structure may include, by way of further example and not by way of limitation, forging, casting and other hot processes for material forming.

A shell 318 includes an outer wall 320 and an inner wall 322. Each of walls 320, 322 is generally symmetrically oriented about an axis 325. Inner wall 322 may embody a first magnetically conductive element. Outer wall 320 may embody a second magnetically conductive element. Walls 320, 322 are joined together at one end by a common end closure (not visible in FIG. 7; see FIG. 3). The common end closure may embody a second locus. Inner wall 322 and the common end closure cooperate to establish an aperture 330 that traverses shell 318. An electromagnetic structure 332 is nested within shell 318 between walls 320, 322 in surrounding relation about aperture 330. Electromagnetic structure 332 may be embodied in a magnetic core, a wound magnetic coil structure, a wound coil about a magnetic core or another electromagnetically contributing structure. It is preferred that electromagnetic structure 332 not extend beyond edges 321, 323 of walls 320, 322, and not extend beyond rim 255 of can 254. Edge 323 may embody a first locus.

Electrical winding 412 is oriented around electromagnetic structure 332 and around wall 320 within a cavity 440 bounded by can 254, rod 252 and the closed end joining can 254 with rod 252 (not visible in FIG. 7; see FIG. 5). It is preferred that electromagnetic structure 332 and winding 412 not extend beyond edges 321, 323 of walls 320, 322, and not extend beyond rim 255 of can 254. Notches 334, 336 in edges 321, 323 may permit electrical passage by winding 412 to contribute toward a low profile structure for apparatus 210. Other notches may also be provided in edges 334, 336 and in walls 320, 322 to accommodate passage of other circuit traces (not shown in FIG. 7) thereby simplifying circuit layout on a substrate in the vicinity of apparatus 210. In the configuration illustrated in FIG. 7, inner wall 322 and outer wall 320 may cooperate to establish a first winding and winding 412 may establish a second winding. Rod 252 and can 254 with the closed end joining can 254 with rod 252 (not visible in FIG. 7; see FIG. 5) may cooperate to establish a third winding.

By way of illustration and not by way of limitation, current may be established to flow through winding 412 in a direction indicated by an arrow 442, and current may be established to flow through rod 252 in a direction indicated by an arrow 444. That arrangement establishes a current flow through all surfaces of can 252 in a direction representatively indicated by arrows 446. Establishing current flows in apparatus 210 as indicated by arrows 442, 444, 446 configures apparatus 210 for handling high frequency signals. Current in winding 412 (arrow 442) is opposite to current in rod 252 (arrow 444) everywhere that winding 412 faces rod 252. Mirror images of current are thus established in winding 412 and rod 252. Similarly, current in winding 412 (arrow 442) is opposite to current in can 254 (arrow 446) everywhere that winding 412 faces can 254. Mirror images of current are thus established in winding 412 and can 254. Mirror images of current are also established in rod 252 and can 254. Current flow in walls 320, 322 may be arranged to mirror currents in rod 252 and can 254, or current in walls 320, 322 may be established to mirror currents in winding 412, as desired. The three-dimensional nature of the structure of apparatus 210 establishes the desirable mirror image currents in a 360 degree arrangement around apparatus 210. Such a three-dimensional mirror image current arrangement contributes to efficient handling of high frequency signaling by apparatus 210. In structures not providing such mirror imaging of currents, current flow tends to migrate toward edges in the structure thereby causing hot spots and contributing to inefficiency of operation. The mass of material that makes up wall 320, wall 320, the end closure joining walls 320, 322 (not visible in FIG. 7; see FIG. 3), rod 252, can 254, and the closed end joining can 254 with rod 252 (not visible in FIG. 7; see FIG. 5) provides a capability for apparatus 210 to handle high currents while presenting a small package. The small package may be manifested as low height, small footprint, low volume or another combination using small size to advantage for a particular application using apparatus 210. Thus, apparatus 210 is a magnetic circuit component that can be effectively employed in high frequency, high current, low resistance applications while presenting a small package.

One skilled in the art may recognize other embodiments that are possible using the teachings of the present invention. Additional shell structures (by way of example and not by way of limitation, of the sort described in connection with FIG. 3) may be nested to add further layers and support further windings in an electromagnetic structure. Windings may be routed to enclose a greater number or lesser number of nested components to achieve various electromagnetic design objectives. By way of example and not by way of limitation, winding 412 (FIG. 7) could be routed to entirely enclose can 254, or winding 412 could be routed to remain within cavity 260. One skilled in the art may also recognize that if the various shells and can-and-rod elements of an apparatus configured according to the teachings of the present invention are permitted to electrically contact one another, then the electromagnetic circuits associated with the contacted elements may be coupled in parallel. In contrast, if the various shells and can-and-rod elements are not permitted to electrically contact one another, then whether the associated electromagnetic circuits are parallel-connected or series-connected is determined by wiring configurations established when coupling the apparatus within a product.

Figure 8:
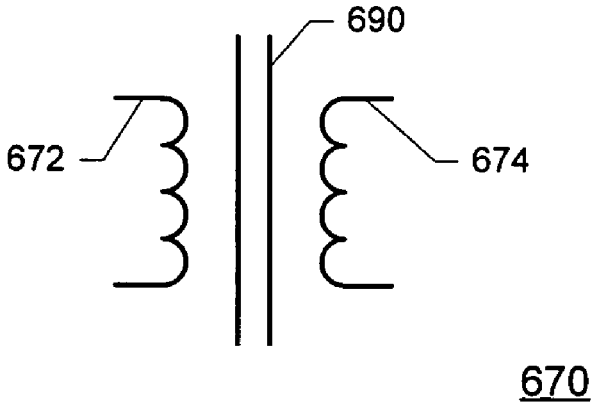
FIG. 8 is a representative electrical schematic diagram of the current sense transformer device described in connection with FIG. 5.

FIG. 8 is a representative electrical schematic diagram of the current sense transformer device described in connection with FIG. 5. In FIG. 8, an electromagnetic apparatus 670 is configured as a current transformer having an electromagnetic core 690, a first magnetic circuit structure 672 and a second magnetic circuit structure 674. Electromagnetic apparatus 670 is configured for employment as a current sense transformer device as described in connection with FIG. 5 in which electromagnetic core 690 is embodied in electromagnetic structure 90, first magnetic circuit structure 672 is embodied in an integral structure including rod 72 and can 74, and second magnetic structure 674 is embodied in electrical winding 100 oriented around electromagnetic structure 90 within cavity 80 (FIG. 5).

Figure 9:
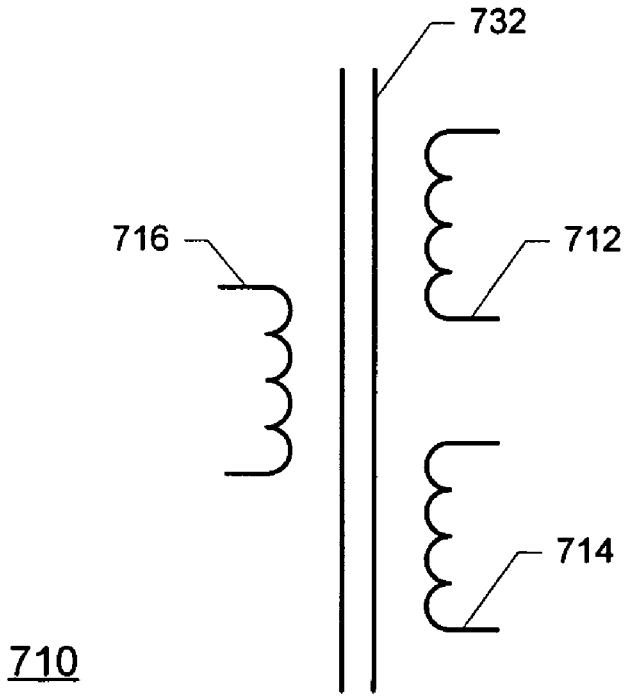
FIG. 9 is a representative electrical schematic diagram of the interleaved shell configuration described in connection with FIG. 7.

FIG. 9 is a representative electrical schematic diagram of the interleaved shell configuration described in connection with FIG. 7. In FIG. 9, an electromagnetic apparatus 710 is configured as a multiple pole transformer having an electromagnetic core 732, a first magnetic circuit structure 712, a second magnetic circuit structure 714 and a third magnetic circuit structure 716. Electromagnetic apparatus 710 may be configured for employment as a multiple pole transformer device as described in connection with FIG. 7 in which electromagnetic core 732 is embodied in electromagnetic structure 332, first magnetic circuit structure 712 is embodied in an integral structure including rod 252 and can 254, second magnetic circuit structure 714 is embodied in shell 318 with outer wall 320 and inner wall 322 joined together at one end by a common end closure, and third magnetic circuit structure 716 is embodied in electrical winding 412 oriented around electromagnetic structure 332 and around wall 320 within a cavity 440 bounded by can 254, rod 252 and the closed end joining can 254 with rod 252.

Each of magnetic circuit structures 712, 714 is established by a respective shell or can structure, preferably assembled in a concentric arrangement generally as described in connection with FIG. 7. Each respective can or shell structure establishes a single turn for an electromagnetic circuit. Connections among respective can or shell structures to establish multiple windings may be effected on a substrate or printed wiring board (not shown in FIGS. 7-9). Serial or parallel connection among windings established by respective can or shell structures may be established. Alternatively, parallel connection between two windings may be established by arranging for respective can or shell structures to contact each other.

Figure 10:
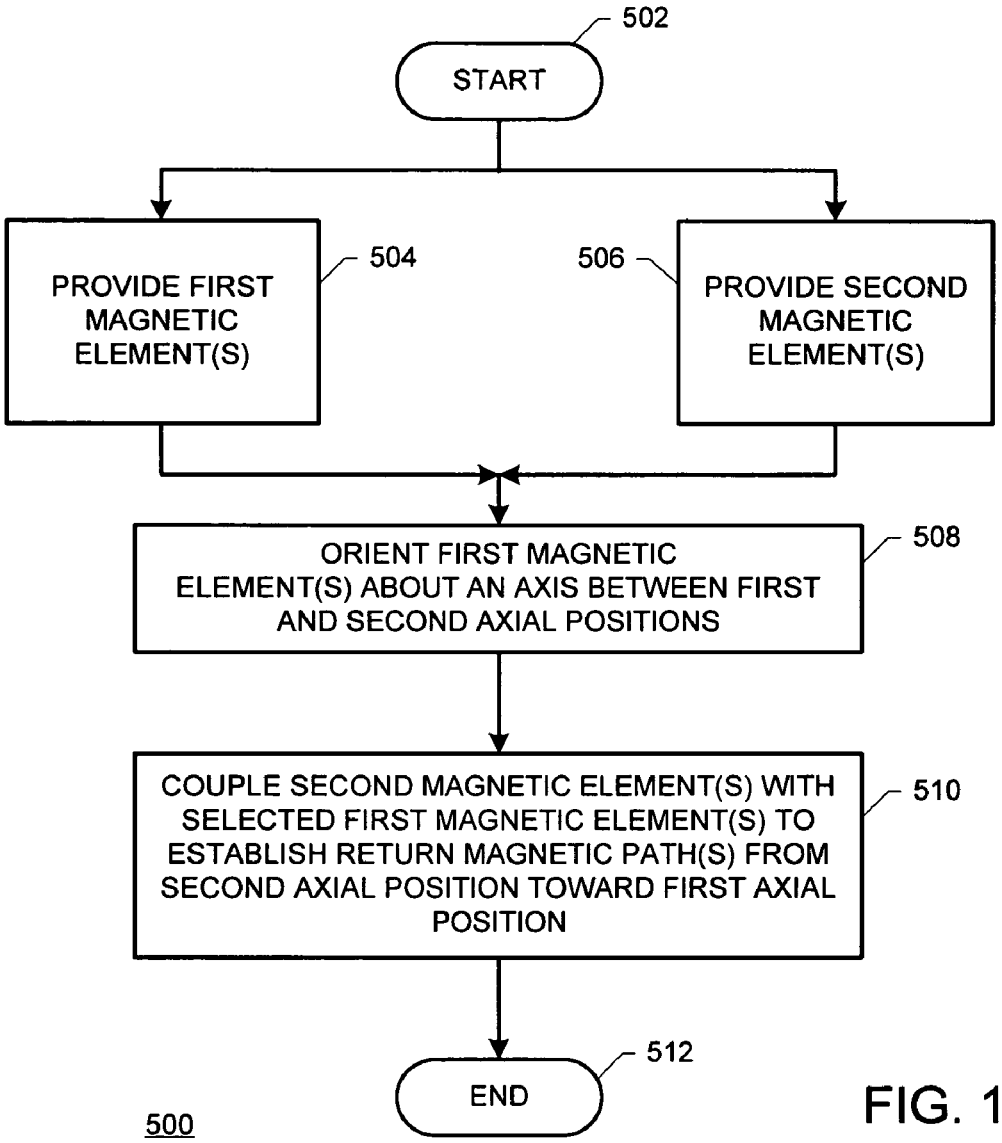
FIG. 10 is a flow chart illustrating the method of the present invention.

FIG. 10 is a flow chart illustrating the method of the present invention. In FIG. 10, a method 500 for establishing at least one turn for a magnetic circuit begins at a START locus 502. Method 500 continues with the step of, in no particular order: (1) providing at least one first magnetic element as indicated by a block 504; and (2) providing at least one second magnetic element as indicated by a block 506. Method 500 continues with orienting the at least one first magnetic element substantially about an axis generally between a first axial position and a second axial position as indicated by a block 508. Method 500 continues with coupling the at least one second magnetic element with at least one selected first magnetic element of the at least one first magnetic element generally at the second axial position to establish at least one return magnetic path from the second axial position generally toward the first axial position as indicated by a block 510. The at least one return magnetic path is generally about the axis. Method 500 terminates at an END block 512.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. An apparatus for establishing a magnetic circuit; the apparatus comprising:

(a) a first magnetically conductive element; the first element being generally symmetrical with respect to an axis and extending from a first locus to a second locus; and (b) a second magnetically conductive element coupled with the first element at the second locus and establishing a return magnetic path from the second locus toward a plane generally perpendicular with the axis and containing the first locus; the return magnetic path being distributed substantially in spaced relation with the first element generally symmetrically about the axis; at least one additional first magnetically conductive element generally symmetrical with respect to the axis and extending from the first locus to the second locus, and at least one additional second magnetically conductive element coupled with at least one of the at least one additional first magnetically conductive element; each respective additional second magnetically conductive element of the at least one additional second magnetically conductive element establishing a respective additional return magnetic path from the second locus toward the plane; each additional return magnetic path being distributed substantially in spaced relation with at least one selected additional first element of the at least one additional first element; each additional return magnetic path being established generally about the axis.

2. An apparatus for establishing a magnetic circuit as recited in claim 1 wherein the first element is a solid rod structure substantially centered on the axis.

3. An apparatus for establishing a magnetic circuit as recited in claim 1 wherein the second element is configured having a substantially polygonal cross section in a plane substantially perpendicular with the axis; the second element having one end effecting the coupling with the first element.

4. An apparatus for establishing a magnetic circuit as recited in claim 1 wherein the second element is configured substantially as a cylindrical structure having one end effecting the coupling with the first element.

5. An apparatus for establishing a magnetic circuit as recited in claim 2 wherein the second element is configured having a substantially polygonal cross section in a plane substantially perpendicular with the axis; the second element having one end effecting the coupling with the first element.

6. An apparatus for establishing a magnetic circuit as recited in claim 2 wherein the second element is configured substantially as a cylindrical structure having one end effecting the coupling with the first element.

7. An apparatus for establishing at least one turn for a magnetic circuit; the apparatus comprising:

(a) at least one first magnetic element oriented substantially about an axis generally between a first axial position and a second axial position; and (b) at least one second magnetic element coupled with at least one selected first magnetic element of the at least one first magnetic element generally at the second axial position; the at least one second magnetic element establishing at least one return magnetic path from the second axial position generally toward the first axial position; the at least one return magnetic path being generally about the axis; at least one additional first magnetically conductive element generally symmetrical with respect to the axis and extending from the first axial position to the second axial position, and at least one additional second magnetically conductive element coupled with at least one of the at least one additional first magnetically conductive element and the first conductive element; each respective additional second magnetically conductive element of the at least one additional second magnetically conductive element establishing a respective additional return magnetic path from the second axial position generally toward the first axial position; each additional return magnetic path being distributed substantially in spaced relation with at least one selected additional first element of the at least one additional first element; each additional return magnetic path being established generally about the axis.

8. An apparatus for establishing at least one turn for a magnetic circuit as recited in claim 7 wherein at least one selected first magnetic element of the at least one first magnetic element is configured for electrical connection with a first electrical termination structure.

9. An apparatus for establishing at least one turn for a magnetic circuit as recited in claim 8 wherein at least one selected second magnetic element of the at least one second magnetic element is configured for electrical connection with a second electrical termination structure.

10. An apparatus for establishing at least one turn for a magnetic circuit as recited in claim 9 wherein the first electrical termination structure and the second electrical termination structure are affixed with a substrate.

11. An apparatus for establishing at least one turn for a magnetic circuit as recited in claim 7 wherein at least one selected first magnetic element of the at least one first magnetic element is a solid rod structure substantially oriented about the axis.

12. An apparatus for establishing at least one turn for a magnetic circuit as recited in claim 7 wherein each respective second magnetic element of the at least one second magnetic element is configured having a substantially polygonal cross section in a plane substantially perpendicular with the axis; each the respective second magnetic element having one end effecting the coupling with a respective the first magnetic element of the at least one first magnetic element.

13. An apparatus for establishing at least one turn for a magnetic circuit as recited in claim 7 wherein at least one respective second magnetic element of the at least one second magnetic element is configured substantially as a cylindrical structure having one end effecting the coupling with a respective the first magnetic element of the at least one first magnetic element.

14. An apparatus for establishing at least one turn for a magnetic circuit as recited in claim 11 wherein each respective second magnetic element of the at least one second magnetic element is configured having a substantially polygonal cross section in a plane substantially perpendicular with the axis; each the respective second magnetic element having one end effecting the coupling with a respective the first magnetic element of the at least one first magnetic element.

15. An apparatus for establishing at least one turn for a magnetic circuit as recited in claim 11 wherein at least one respective second magnetic element of the at least one second magnetic element is configured substantially as a cylindrical structure having one end effecting the coupling with a respective the first magnetic element of the at least one first magnetic element.

* * * * *